US012467711B2

(12) United States Patent
Findlay et al.

(10) Patent No.: US 12,467,711 B2
(45) Date of Patent: Nov. 11, 2025

(54) GUN SUPPORT ELEVATION ADJUSTER

(71) Applicant: AMP Annealing Limited, Pukekohe (NZ)

(72) Inventors: Alexander Findlay, Pukekohe (NZ); Matthew Findlay, Pukekohe (NZ)

(73) Assignee: AMP Annealing Limited, Pukekohe (NZ)

( * ) Notice: Subject to any disclaimer, the term of this patent is extended or adjusted under 35 U.S.C. 154(b) by 0 days.

(21) Appl. No.: 18/602,791

(22) Filed: Mar. 12, 2024

(65) Prior Publication Data

US 2024/0310139 A1 Sep. 19, 2024

Related U.S. Application Data

(60) Provisional application No. 63/489,810, filed on Mar. 13, 2023.

(51) Int. Cl.
*F41A 27/24* (2006.01)

(52) U.S. Cl.
CPC ..... *F41A 27/24* (2013.01)

(58) Field of Classification Search
CPC ..... F41A 23/06; F41A 23/10; F41A 23/14; F41A 27/24
USPC ..... 89/40.01–40.16
See application file for complete search history.

(56) References Cited

U.S. PATENT DOCUMENTS

| | | | | | |
|---|---|---|---|---|---|
| 1,573,496 | A * | 2/1926 | Jansson | F16M 11/046 | 248/404 |
| 4,441,401 | A * | 4/1984 | Hobson | F41A 27/24 | 89/36.13 |
| 5,058,446 | A * | 10/1991 | Guey | F16M 11/046 | 248/404 |
| 2013/0185980 | A1* | 7/2013 | Griffin | F41A 23/10 | 42/94 |
| 2013/0270405 | A1* | 10/2013 | Hunter | F16M 11/36 | 248/125.8 |
| 2017/0175949 | A1* | 6/2017 | Cardozo | F16H 19/04 | |

FOREIGN PATENT DOCUMENTS

| | | | | |
|---|---|---|---|---|
| AU | 2021201180 | A1 * | 9/2021 | |
| EP | 2722634 | A1 * | 4/2014 | F41G 3/00 |
| WO | WO-2019134020 | A1 * | 7/2019 | F41A 23/10 |

* cited by examiner

*Primary Examiner* — Bret Hayes
(74) *Attorney, Agent, or Firm* — Leason Ellis LLP

(57) ABSTRACT

An elevation adjuster for a gun support includes a support mount for detachably mounting the elevation adjuster to a gun support, a base portion connected to the support mount, and a pinion rotatably connected to the base portion. The elevation adjuster further includes an extendible member slidably engaged with the base portion. The extendible member comprises a rack portion which is engaged with the pinion, such that rotation of the pinion causes the extendible member to move relative to the base portion. The pinion is connected to a handle for manipulation by a user of a gun which is connected, in use, to the elevation adjuster. The extendible member comprises a gun mount for detachably connecting the elevation adjuster to a gun.

20 Claims, 9 Drawing Sheets

GUN SUPPORT ELEVATION ADJUSTER

CROSS REFERENCE TO RELATED APPLICATION

The present application claims priority to and the benefit of U.S. patent application Ser. No. 63/489,810, filed Mar. 13, 2023, which is hereby expressly incorporated by reference in its entirety.

FIELD OF THE TECHNOLOGY

The present invention relates to gun supports, and in particular, but not exclusively, to bipod type supports and apparatus for use therewith.

BACKGROUND TO THE TECHNOLOGY

Many gun users, particularly when hunting or in competition, use a gun support to increase accuracy. A bipod is one common type of gun support. The bipod is attached to the handguard of the gun (typically a long gun such as a rifle or similar) toward the muzzle end. The elevation angle of the gun can then be controlled by changing the elevation of the stock, or by keeping the stock at a constant height and changing the height of the bipod.

Greatest accuracy is achieved when the stock of the gun is rested on a stable support surface and the elevation is adjusted by changing the bipod height. However, most height adjustable bipods have telescoping legs which must be adjusted individually. These are often difficult for a user to adjust from a firing position, and often only offer a coarse adjustment.

Electromechanical firearm rests are also known, but these may be expensive, cumbersome, and may require an electrical power source to operate.

OBJECT OF THE TECHNOLOGY

It is an object of the technology to provide an attachment for a gun support which is easily adjusted from a firing position, and which allows fine adjustment. It is a further object to provide an attachment for a gun support which does not require an electrical power source.

Alternatively, it is an object of the technology to provide a useful choice.

SUMMARY OF THE TECHNOLOGY

According to one aspect of the technology there is provided an elevation adjuster for a gun support, the elevation adjuster comprising:

- a support mount for detachably mounting the elevation adjuster to a gun support;
- a base portion connected to the support mount;
- a pinion rotatably connected to the base portion;
- an extendible member slidably engaged with the base portion, wherein the extendible member comprises a rack portion which is engaged with the pinion, such that rotation of the pinion causes the extendible member to move relative to the base portion, the pinion connected to a handle for manipulation by a user of a gun which is connected, in use, to the elevation adjuster,
- wherein the extendible member comprises a gun mount for detachably connecting the elevation adjuster to a gun, in use.

In one example, the handle is connected to the pinion by an elongate shaft.

In one example, the combined length of the handle and the shaft is around 150 mm.

In one example, the elevation adjuster comprises locking means for selectively locking the position of the extendible member relative to the base portion.

In one example, the locking means comprises a locking formation provided to the base portion, wherein the locking formation is configured to be engageable with the pinion.

In one example, the locking formation comprises a recess with a complementary shape to the pinion.

In one example, the pinon is biased towards the recess.

In one example, the base portion is formed integrally with the support mount.

In one example, the base portion extends substantially vertically in use.

In one example, the base portion comprises a hollow housing.

In one example, the extendible member comprises a slot and the rack portion is provided to, or forms at least a part of, an internal wall of the slot.

In one example, the locking means comprises a ratchet mechanism.

In one example, the base portion comprises a housing, and wherein the ratchet mechanism comprises a plurality of ratchet teeth provided to the extendible member and a pawl rotatably connected to the housing.

In one example, the pawl is connected to a release mechanism which allows the user to disengage the pawl from the ratchet teeth.

In one example, the release mechanism comprises a button which extends through the housing and a lever which is connected to, or formed with, the button and which is connected to the pawl.

In one example, the release mechanism comprises a collar with a radially outwardly extending flange, the collar being connected or connectable to a shaft to which the handle is mounted and slidable parallel to a rotational axis of the pinion, wherein the pawl comprises a projecting portion which can be engaged by the flange to release the pawl.

Further aspects of the technology, which should be considered in all its novel aspects, will become apparent to those skilled in the art upon reading of the following description which provides at least one example of a practical application of the technology.

BRIEF DESCRIPTION OF THE DRAWINGS

One or more embodiments of the technology will be described below by way of example only, and without intending to be limiting, with reference to the following drawings, in which.

BRIEF DESCRIPTION OF EXEMPLARY FORMS OF THE TECHNOLOGY

Figure 1:
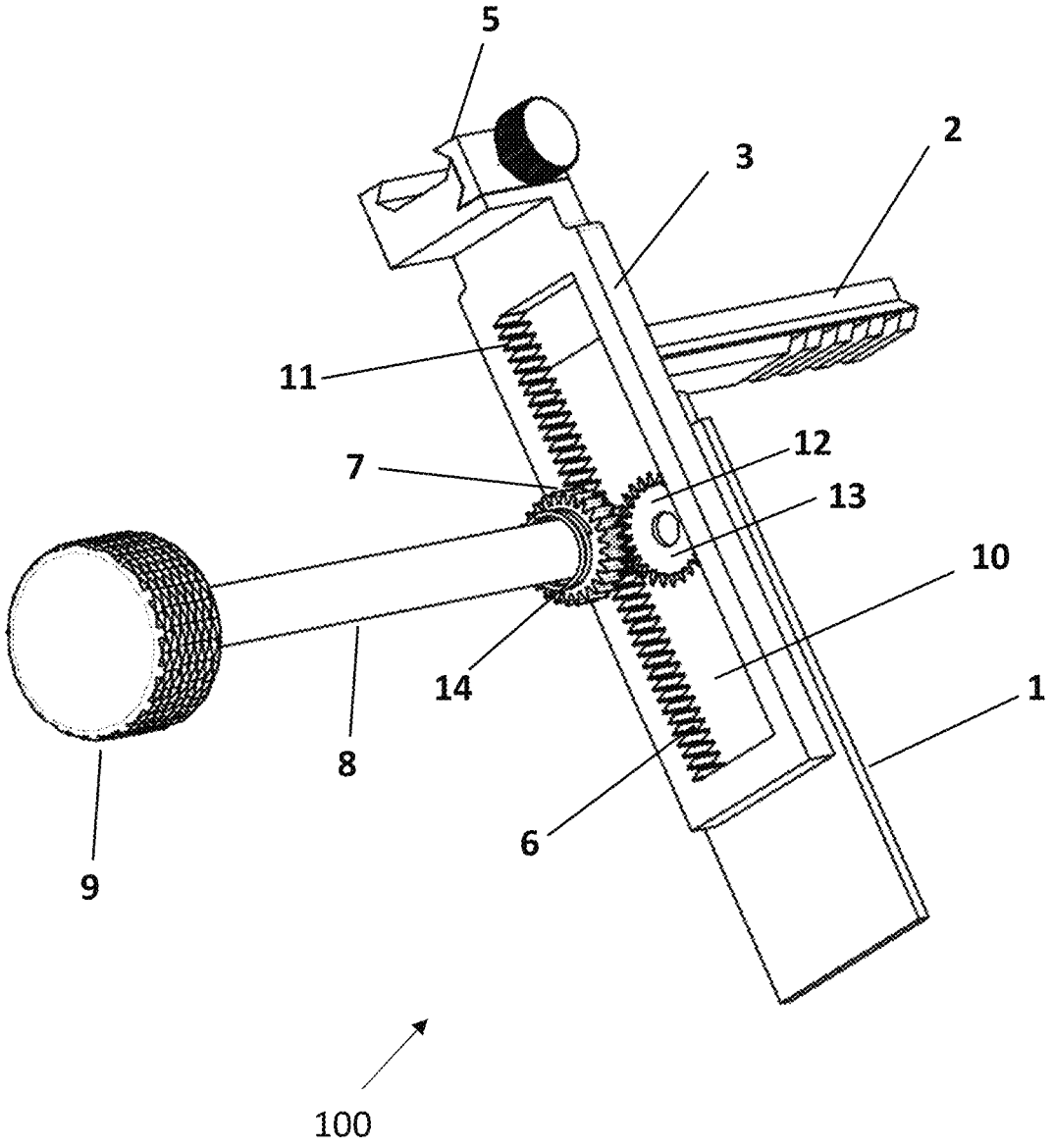
FIG. 1 is a rear perspective view of an elevation adjuster for a gun support according to one form of the technology, with the side and rear walls of the housing removed and the position of the pinion and handle adjusted to show the extendible member and the interior of the housing more clearly.

Referring first to FIGS. 1-6, an elevation adjuster for a gun support is generally referenced by arrow 100.

The elevation adjuster 100 comprises a base portion 1 connected to a support mount 2. The support mount 2 may comprise any suitable mount which allows for detachable connection of the elevation adjuster 100 to a gun support (preferably a bipod, not shown). In one example the support mount 2 may comprise a Picatinny Rail type mount, although other mount types such as the ARCA or standard sling swivel mount may also be used. In examples, the support mount 2 may be formed integrally (e.g. as one piece) with the base portion 1, or with at least part of the base portion 1.

The base portion 1 is configured to extend substantially vertically in use, and to engage an extendible member 3 in a sliding engagement. In one form of the technology the base portion 1 comprises a substantially hollow housing 4 and the extendible member 3 is slidably engaged with at least one interior wall of the housing 4.

The extendible member 3 comprises a gun mount portion 5 at a distal end of the extendible member 3 to the engagement with the base portion 1. The gun mount 5 is configured to be above the base portion 1 in use. The gun mount 5 may be of any suitable type, e.g. Picatinny Rail, which provides a detachable connection. In examples the gun mount 5 is the of the same type as the support mount 2. In this way the adjuster 100 can be used between any bipod and any gun, provided they have the correct mounts.

As best seen in FIG. 1, the extendible member 3 comprises a rack portion 6 which is engaged with a pinion 7 which is rotatably mounted to the base portion 1. For example, the pinion 7 may be connected to an elongate shaft 8 which is rotatably engaged with the base portion 1. The shaft may be connected to a handle portion 9, e.g. a knob, as shown in the figures.

In one form of the technology the extendible member 3 comprises an elongate slot 10 or channel and the rack portion 6 is provided to, or forms at least a part of, an internal wall 11 of the slot 10. However, in other examples (not shown) the rack portion 6 may be provided to, or may form at least a part of, an external side wall of the extendible member 3. Rotation of the pinion 7, when the pinion 7 is engaged with the rack 6, causes relative movement of the extendible member 3 relative to the base portion 1, and hence movement of the gun mount 5 relative to the support mount 2.

In one form of the technology the elevation adjuster 100 comprises locking means for selectively locking or holding the position of the extendible member 3 relative to the base portion 1 In examples, the locking means may only prevent relative motion between the extendible member 3 and base portion 1 in one direction. For example, the elevation adjuster 100 may comprise means for locking the rotational position of the pinion 7, and thereby locking the extendible member 3. In other forms the locking means may comprise one or more of: a ratchet mechanism between the base portion and the extendible member; a pin which is selectively engageable with the base portion and the extendible member; a screw which is threadingly engaged with the base portion (e.g. the housing) and which engages the extendible member; and a clamp which clamps the base to the extendible member.

In one form, the base portion 1 may comprise a locking formation 12 and the pinion 7 may be brought into contact with the locking formation 10 to fix the position of the extendible member 3. The pinion 7 may be moved out of contact with the locking formation 12 to allow the position of the extendible member 3 to be adjusted.

For example, as described above, the pinion 7 may be connected to an elongate shaft 8 which is rotatably connected to the base portion 1. In the example shown the shaft 8 extends through an aperture (not shown) in the housing 4 and is slidable along its length dimension (e.g. parallel to its central axis) relative to the housing 4. The base portion 1 may comprise a locking formation in the form of a recessed portion 13 which has a complementary shape to at least one tooth of the pinion 7. In one example the recessed portion 13 has a complementary shape to the entire pinion 7. The depth of the recessed portion 13 may be less than the width of the pinion 7, such that even when the pinion 7 is fully engaged with the recess, a portion of the pinion 7 extends out from the recess and is in contact with the rack portion 6.

Figure 2:
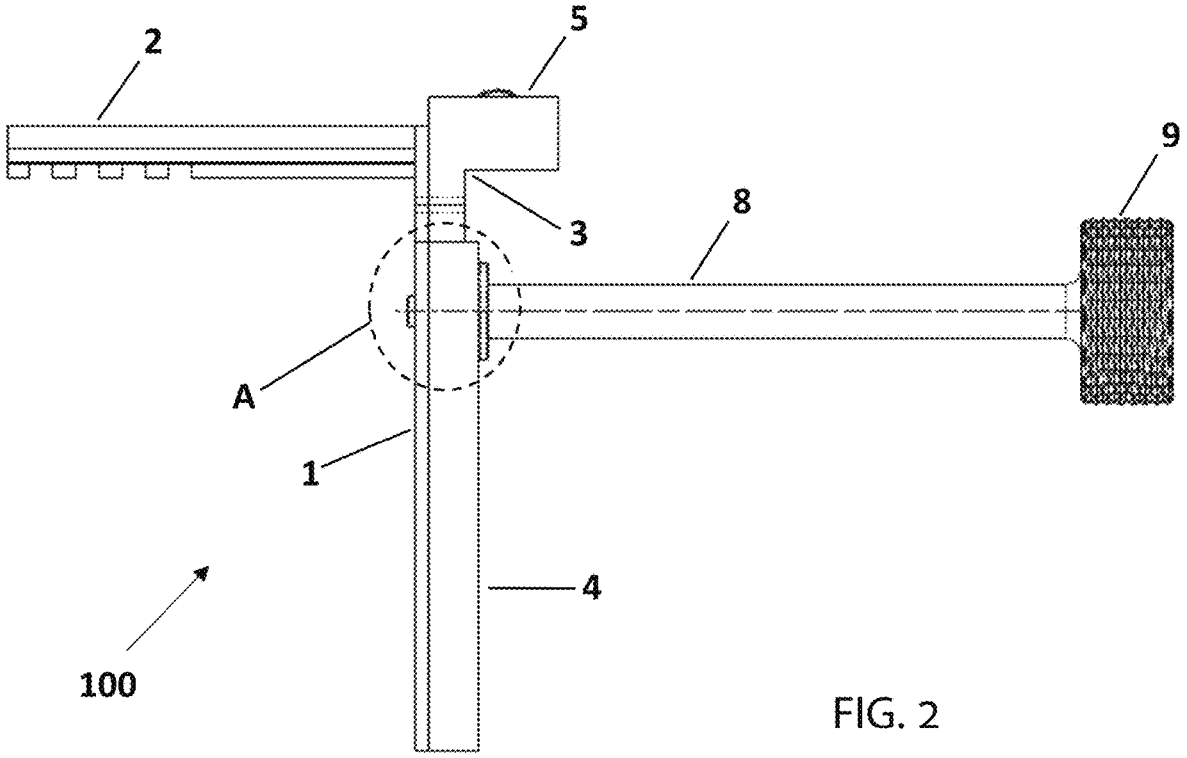
FIG. 2 is a side view of the elevation adjuster of FIG. 1 with the extendible member shown in a non-extended position.
Figure 2A:
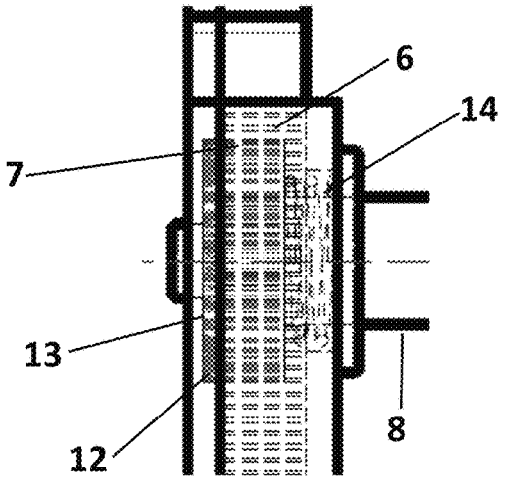
FIG. 2A is an enlarged view of area A of FIG. 2, with the recess, rack, pinion and spring shown in hidden detail.
Figure 3:
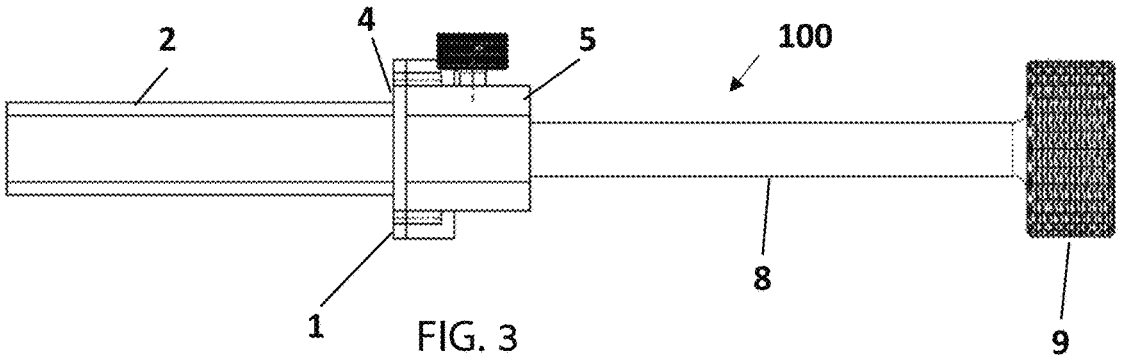
FIG. 3 is a top view of the elevation adjuster for a gun support of FIG. 1.
Figure 4:
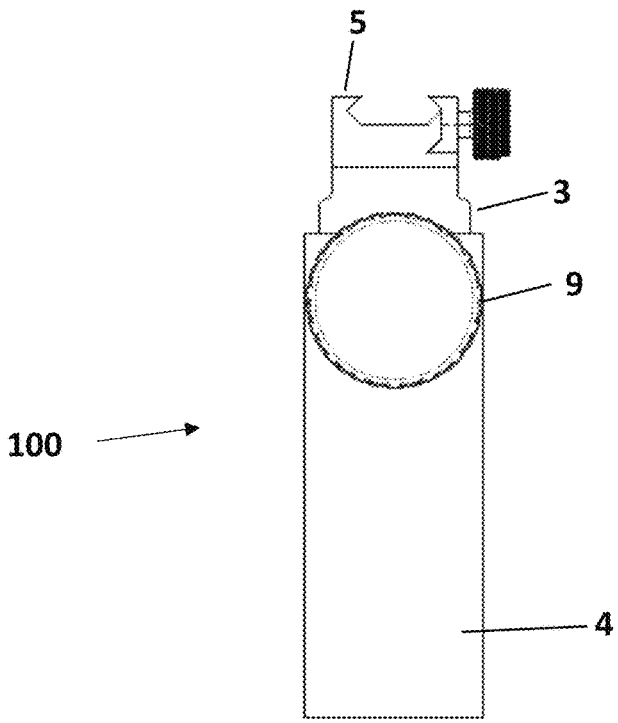
FIG. 4 is a rear view of the elevation adjuster for a gun support of FIG. 1 with the extendible member shown in a non-extended position.
Figure 5:
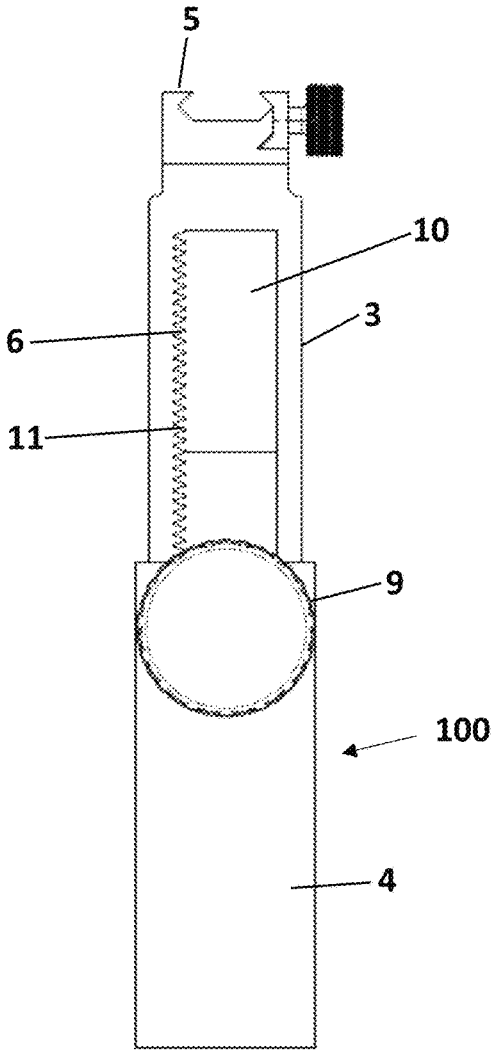
FIG. 5 is a rear view of the elevation adjuster for a gun support of FIG. 1 with the extendible member shown in a fully extended position.
Figure 6:
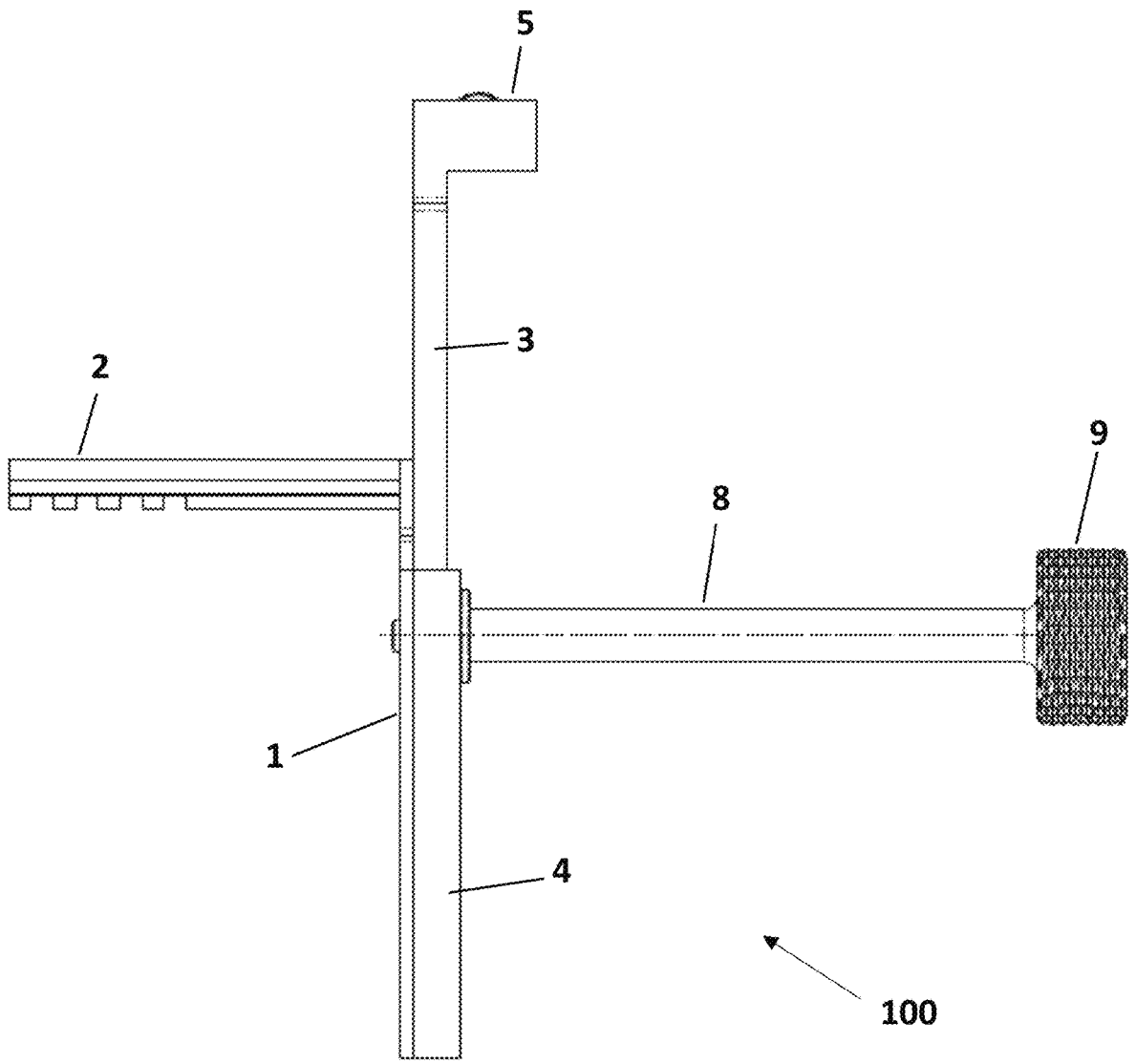
FIG. 6 is a side view of the elevation adjuster of FIG. 1 with the extendible member shown in a fully extended position.
Figure 7:
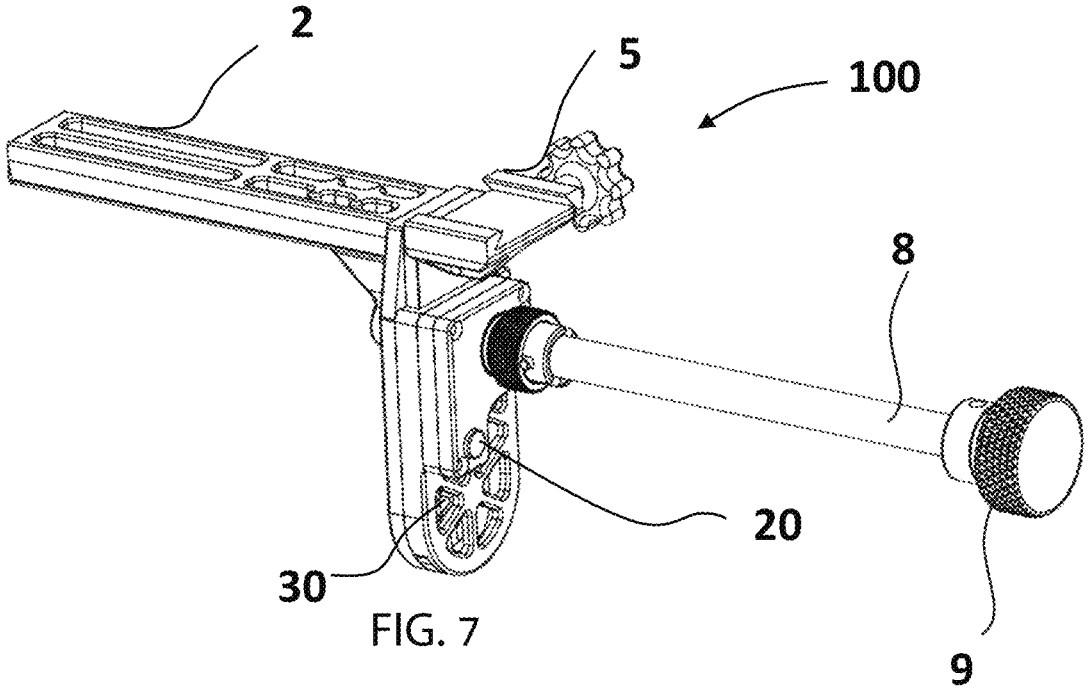
FIG. 7 is a rear perspective view of the elevation adjuster according to another form of the technology, in a non-extended configuration.
Figure 8:
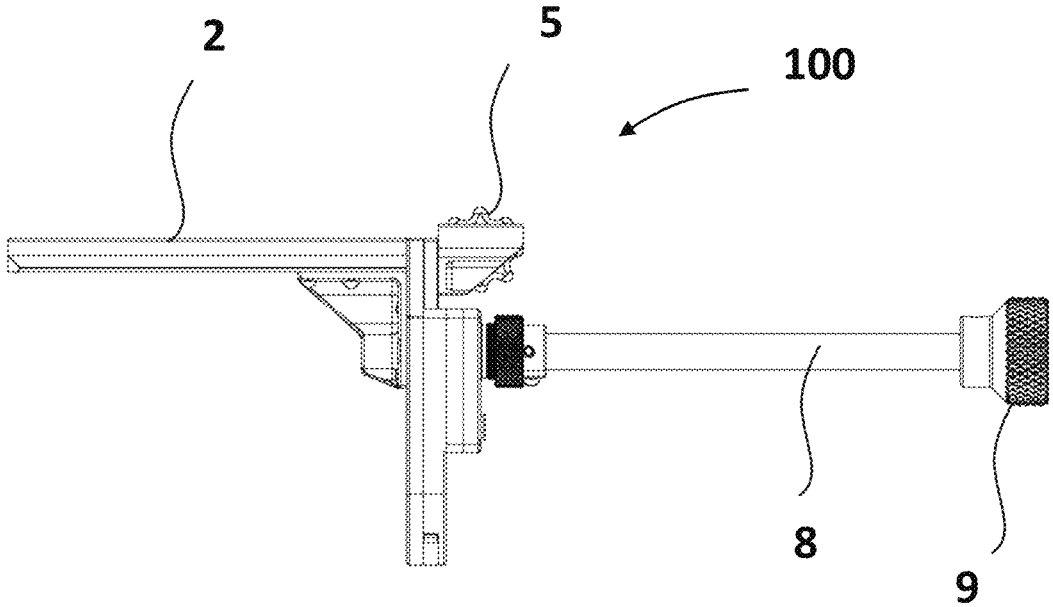
FIG. 8 is a side view of the elevation adjuster of FIG. 7.

The pinion 7 may be biased towards the locking formation 12 (e.g. the recessed portion 13) by a biasing means 14 such as a spring, as best seen in FIGS. 1 and 2A. To allow adjustment of the elevation adjuster 100 the pinion 7 may be pulled out of the recess 13, against the bias force of the spring, and then rotated until the gun is at the correct elevation. Once the correct elevation has been achieved, the user may release the handle portion 9 and the spring 14 may urge the pinion 7 back into engagement with the recess 13, thereby locking the apparatus in position.

In examples, the combined length of the shaft 8 and the handle 9 may be around 150 mm. This may allow a user to grasp the handle 9 while simultaneously aiming the gun (e.g. using a scope). In some examples the shaft is longer than the handle, but other examples the handle may be longer than the shaft. In one form (not shown) the shaft may be extendible so that the position of the handle can be adjusted (e.g. using a telescoping mechanism) to accommodate differences in mounting points between different types of rifle.

Figure 11:
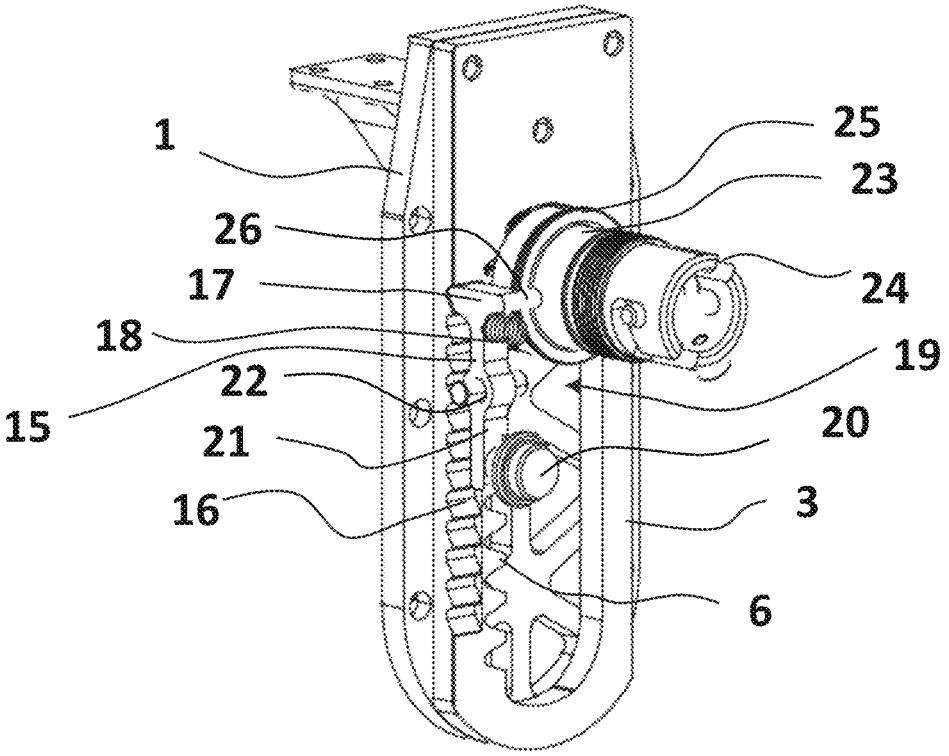
FIG. 11 is an enlarged rear perspective view of the base and extendible member of the elevation adjuster of FIG. 7 with the shaft, gun mount, support mount and housing removed.
Figure 12:
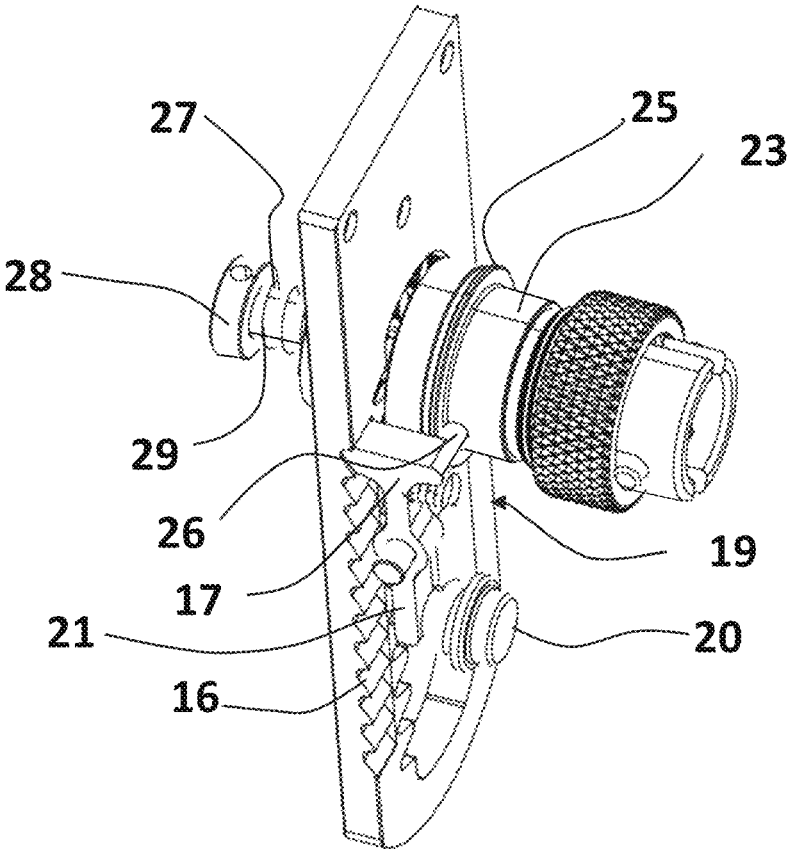
FIG. 12 is a further an enlarged rear perspective view of the base and extendible member of the elevation adjuster of FIG. 7 with the shaft, gun mount, support mount and housing removed.

Referring next to FIGS. 7-12, another example of the elevation adjuster 100 is shown. In the example shown in these figures, the locking means takes the form of a ratchet mechanism 15. As best seen in FIGS. 11 and 12, the extendible member comprises a plurality of ratchet teeth 16. In the example shown the ratchet teeth 16 are provided to a rear face of the extendible member 3 (e.g. arranged orthogonally to the teeth of the rack portion 6), but in other examples (not shown) the ratchet teeth 16 may be provided to a side of the extendible member 3 (e.g. parallel to the teeth of the rack portion). A pawl 17 is connected to the housing 4 by a rotatable connection 22, and is positioned so as to engage the ratchet teeth 16. A biasing means 18, for example a spring, urges the pawl 17 into engagement with the ratchet teeth 16. While a compression spring is shown, any suitable biasing means, for example a torsion spring, may be used.

In the example shown the ratchet 15 is configured to allow the gun mount 5 to be elevated relative to the support mount 2, but to prevent a reduction in the elevation unless a release mechanism 19 (described further below) is activated.

In examples of the technology, the pawl 17 is connected to a release mechanism 19 which allows the user to disengage the pawl 17 from the teeth. In one form of the technology, best seen in FIGS. 11 and 12, the release mechanism 19 is in the form of a button 20 which extends through the housing 4 and a lever 21 which is connected to, or formed with, the button 20. The lever 21 is provided to an opposite side of the rotatable connection 22 to the pawl 17, such that pushing the button 20 moves the pawl 17 out of engagement with the ratchet teeth 16. In this way the elevation adjuster 100 can be quickly moved to a fully collapsed (e.g. de-elevated) configuration.

In some forms of the technology the release mechanism 19 may additionally (or alternatively) comprise means for disengaging the pawl 17 when the shaft 8 is moved backward (relative to the housing 4) by the user. The release mechanism 19 may comprise a collar 23 which is connected to the pinion 7 (directly or indirectly) to rotate with the pinion 7. The collar 23 may be permanently connected to, or integrally formed with, the shaft 8, or it may be releasably connectable to the shaft 8. In the example shown the shaft 8 is releasably connectable to the collar 23 by a bayonet fitting 24 (although any suitable alternative may be used).

The collar 23 may comprise an annular flange 25 which extends radially outward. The pawl 17 may comprise a projecting portion 26, for example a pin or similar, which extends towards the collar 23. The flange 25 and projecting portion 26 may overlap, such that when the user pulls the handle 9 (and hence the shaft 8 and collar 23) the flange 25 engages the projecting portion 26 and moves the pawl 17 out of engagement with the ratchet teeth 16.

Figure 9:
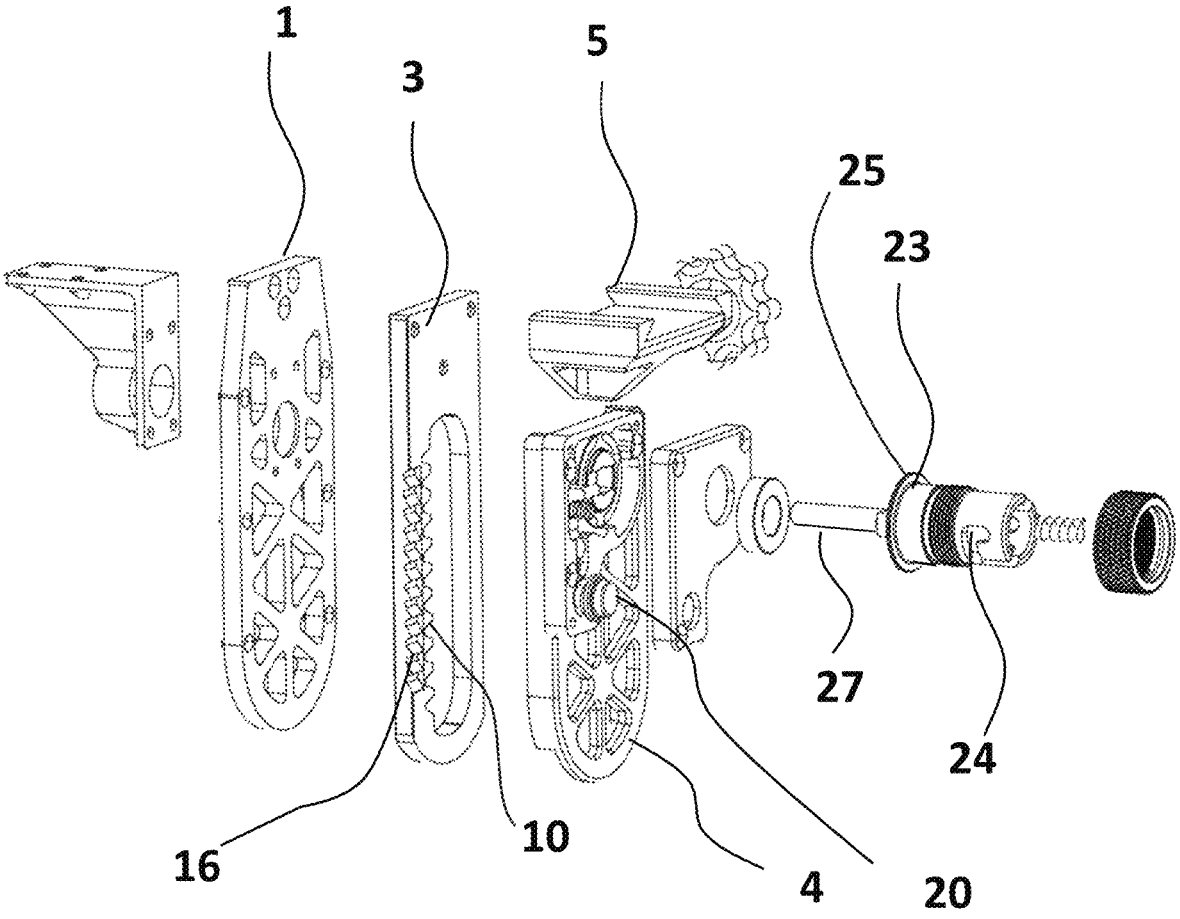
FIG. 9 is an exploded view of the elevation adjuster of FIG. 7 with the support mount not shown.
Figure 10:
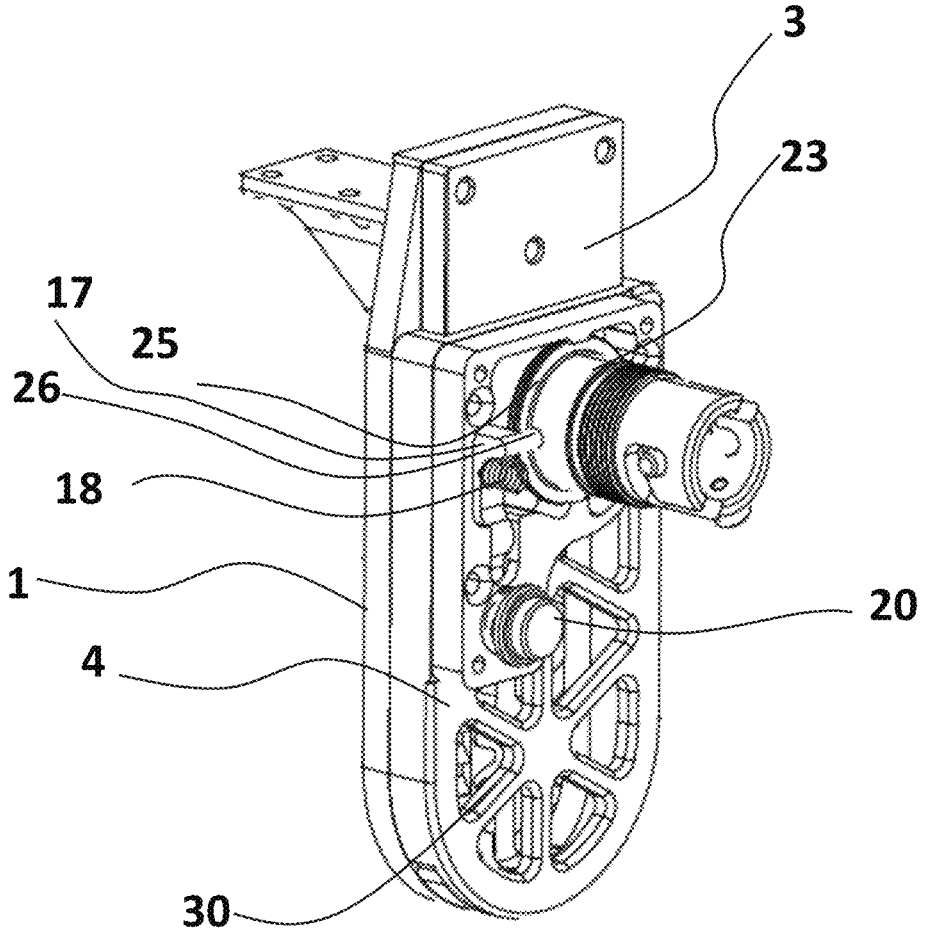
FIG. 10 is an enlarged rear perspective view of the base and extendible member of the elevation adjuster of FIG. 7 with the shaft, gun mount, support mount and an outer cover removed.

As best seen in FIGS. 9 and 12 the collar 23 is connected to a shaft 27 which extends though the pinion 7 and is connected to a disc shaped stop portion 28 located on an opposite side (e.g. front) of the base portion 1. A biasing means, typically a spring 29, is provided between the stop portion 28 and the base portion 1, and biases the shaft 8 and collar 23 forwards, that is, into a position in which the flange 25 does not engage the pin 26 (or at least, does not put sufficient force on the pin 26 to disengage the pawl 17 from the ratchet teeth 16).

This release mechanism 19 allows the user to lower or de-elevate the gun mount 5 relative to the support mount 2. Use of the release mechanism 19 also allows the gun mount 5 to be elevated relative to the support mount 2 without the pawl 17 engaging the ratchet teeth 16, for example if quieter operation is required. This may be particularly important when hunting. In the example shown in FIGS. 7-12, a plurality of apertures 30 are provided through the housing 4. In examples, the housing 4 may be in the form of a framework rather than a solid shell.

Those skilled in the art will appreciate the examples of the present invention, when used with a suitable support (e.g. a bipod), allows a user to easily and quickly make accurate adjustments to the elevation of a gun while simultaneously aiming the gun, and to maintain the elevation at the required angle. In examples, the stock of the gun is kept at a substantially constant height during the process of aiming the gun and adjusting the elevation of the gun with the elevation adjuster 100. The apparatus is not unnecessarily heavy or complex, and is manually operated, with no need for an electrical power source.

1.1. Other Remarks

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

The entire disclosures of all applications, patents and publications cited above and below, if any, are herein incorporated by reference.

Reference to any prior art in this specification is not, and should not be taken as, an acknowledgement or any form of suggestion that that prior art forms part of the common general knowledge in the field of endeavour in any country in the world.

The technology may also be said broadly to consist in the parts, elements and features referred to or indicated in the specification of the application, individually or collectively, in any or all combinations of two or more of said parts, elements or features.

Where in the foregoing description reference has been made to integers or components having known equivalents thereof, those integers are herein incorporated as if individually set forth.

It should be noted that various changes and modifications to the presently preferred embodiments described herein will be apparent to those skilled in the art. Such changes and modifications may be made without departing from the spirit and scope of the technology and without diminishing its attendant advantages. It is therefore intended that such changes and modifications be included within the present technology.

The invention claimed is:

1. An elevation adjuster for a gun support, the elevation adjuster comprising:

a support mount for detachably mounting the elevation adjuster to a gun support;

a base portion connected to the support mount;

a pinion rotatably connected to the base portion; and an extendible member slidably engaged with the base portion, wherein the extendible member comprises a rack portion which is engaged with the pinion, such that rotation of the pinion causes the extendible member to move relative to the base portion, the pinion connected to a handle for manipulation by a user of a gun which is connected, in use, to the elevation adjuster, wherein the extendible member comprises a gun mount for detachably connecting the elevation adjuster to a gun, wherein the elevation adjuster comprises locking means for selectively locking the position of the extendible member relative to the base portion, and wherein the locking means comprises a locking formation provided to base portion, wherein the locking formation is configured to be engageable with the pinion.

2. The elevation adjuster of claim 1, wherein the locking formation comprises a recess with a complementary shape to the pinion.

3. The elevation adjuster of claim 2, wherein the pinon is biased towards the recess.

4. The elevation adjuster of claim 1, wherein the base portion is formed integrally with the support mount.

5. The elevation adjuster of claim 1, wherein the base portion extends substantially vertically in use.

6. The elevation adjuster of claim 1, wherein the base portion comprises a hollow housing.

7. The elevation adjuster of claim 1, wherein the extendible member comprises a slot and the rack portion is provided to, or forms at least a part of, an internal wall of the slot.

8. An elevation adjuster for a gun support, the elevation adjuster comprising:

a support mount for detachably mounting the elevation adjuster to a gun support;

a base portion connected to the support mount;

a pinion rotatably connected to the base portion; and an extendible member slidably engaged with the base portion, wherein the extendible member comprises a rack portion which is engaged with the pinion, such that rotation of the pinion causes the extendible member to move relative to the base portion, the pinion connected to a handle for manipulation by a user of a gun which is connected, in use, to the elevation adjuster, wherein the extendible member comprises a gun mount for detachably connecting the elevation adjuster to a gun, wherein the elevation adjuster comprises locking means for selectively locking the position of the extendible member relative to the base portion such that the extendible member cannot be moved relative to the base portion in at least one direction, and wherein the locking means comprises a ratchet mechanism.

9. The elevation adjuster of claim 8, wherein the base portion comprises a housing, and wherein the ratchet mechanism comprises a plurality of ratchet teeth provided to the extendible member and a pawl rotatably connected to the housing.

10. The elevation adjuster of claim 9, wherein the pawl is connected to a release mechanism which allows the user to disengage the pawl from the teeth.

11. The elevation adjuster of claim 10, wherein the release mechanism comprises a button which extends through the housing and a lever which is connected to, or formed with, the button and which is connected to the pawl.

12. The elevation adjuster of claim 10, wherein the release mechanism comprises a collar with a radially outwardly extending flange, the collar being connected or connectable to a shaft to which the handle is mounted and slideable parallel to a rotational axis of the pinion, wherein the pawl comprises a projecting portion which can be engaged by the flange to release the pawl.

13. The elevation adjuster of claim 10, wherein the release mechanism comprises a button which extends through the housing and a lever which is connected to, or formed with, the button and which is connected to the pawl, the release mechanism further comprising a collar with a radially outwardly extending flange, the collar being connected or connectable to a shaft to which the handle is mounted and slideable parallel to a rotational axis of the pinion, wherein the pawl comprises a projecting portion which can be engaged by the flange to release the pawl.

14. The elevation adjuster of claim 8, configured for use with a bipod.

15. The elevation adjuster of claim 8, wherein the handle is connected to the pinion by a shaft.

16. The elevation adjuster of claim 15, wherein the combined length of the handle and the shaft is about 150 mm.

17. The elevation adjuster of claim 15, wherein the combined length of the handle and the shaft is adjustable.

18. The elevation adjuster of claim 8, wherein the base portion is formed integrally with the support mount.

19. The elevation adjuster of claim 8, wherein the base portion comprises a hollow housing.

20. The elevation adjuster of claim 8, wherein the extendible member comprises a slot and the rack portion is provided to, or forms at least a part of, an internal wall of the slot.

* * * * *